US010851719B2

(12) United States Patent
Drabek et al.

(10) Patent No.: US 10,851,719 B2
(45) Date of Patent: Dec. 1, 2020

(54) SYSTEMS FOR SUPPLYING FUEL TO FUEL-INJECTED ENGINES IN GENSETS

(71) Applicant: Cummins Power Generation IP, Inc., Minneapolis, MN (US)

(72) Inventors: Hans L. Drabek, St. Paul, MN (US); Lowell K. Siewert, Herne (GB); Ryan A. Becker, Minneapolis, MN (US); Allen B. Carney, Vadnais Heights, MN (US)

(73) Assignee: Cummins Power Generation IP, Inc., Minneapolis, MN (US)

( * ) Notice: Subject to any disclaimer, the term of this patent is extended or adjusted under 35 U.S.C. 154(b) by 1051 days.

(21) Appl. No.: 14/724,582

(22) Filed: May 28, 2015

(65) Prior Publication Data

US 2015/0345456 A1 Dec. 3, 2015

Related U.S. Application Data

(60) Provisional application No. 62/004,415, filed on May 29, 2014.

(51) Int. Cl.

| | |
|---|---|
| ***F02M 37/10*** | (2006.01) |
| ***F02M 37/20*** | (2006.01) |
| ***F02B 63/04*** | (2006.01) |
| ***F02D 33/00*** | (2006.01) |

(52) U.S. Cl.

CPC ..... *F02D 33/003* (2013.01); *F02M 37/10* (2013.01); *F02B 63/04* (2013.01); *F02M 37/20* (2013.01)

(58) Field of Classification Search

CPC ..... F02B 63/04; F02B 63/044; F02B 63/048; F02B 63/047; F02D 29/06; F02D 33/003; H02K 7/1815; F02M 37/10; F02M 37/20

USPC ..... 123/2, 3; 290/1 A

See application file for complete search history.

(56) References Cited

U.S. PATENT DOCUMENTS

| | | | | |
|---|---|---|---|---|
| 4,539,965 | A | 9/1985 | Soltau | |
| 4,579,093 | A | 4/1986 | Eanes | |
| 4,844,043 | A | 7/1989 | Keller | |
| 4,848,283 | A | 7/1989 | Garms et al. | |
| 5,103,793 | A | 4/1992 | Riese et al. | |
| 5,368,001 | A | 11/1994 | Roche | |
| 5,389,245 | A | 2/1995 | Jaeger et al. | |
| 5,579,740 | A | 12/1996 | Cotton et al. | |
| 5,647,331 | A | 7/1997 | Swanson | |
| 5,724,936 | A * | 3/1998 | Osakabe | F02B 61/045 123/195 A |

(Continued)

FOREIGN PATENT DOCUMENTS

| | | |
|---|---|---|
| JP | 03-822662 | 9/2006 |
| JP | 03-914583 | 5/2007 |
| WO | WO-2008/067622 | 6/2008 |

*Primary Examiner* — Sizo B Vilakazi

(74) *Attorney, Agent, or Firm* — Foley & Lardner LLP

(57) ABSTRACT

Systems are disclosed for supplying fuel to fuel-injected gensets in a recreational vehicle. An apparatus includes a fuel injection system having a fuel reservoir and a first pump fluidly coupled to the first reservoir and structured to supply fuel to the fuel reservoir. The fuel injection system is further provided with a pressure sensor and a second pump. The second pump is fluidly coupled to the pressure sensor and structured to provide pressurized fuel from the fuel reservoir to one or more fuel injectors of an associated engine. The second pump is a variable speed fuel pump.

22 Claims, 7 Drawing Sheets

(56) References Cited

U.S. PATENT DOCUMENTS

| | | | |
|---|---|---|---|
| 5,855,197 | A | 1/1999 | Kato |
| 5,865,160 | A | 2/1999 | Kato |
| 5,873,347 | A | 2/1999 | Kato et al. |
| 5,908,020 | A | 6/1999 | Boutwell et al. |
| 6,216,671 | B1 | 4/2001 | Sawert et al. |
| 6,257,208 | B1 | 7/2001 | Harvey |
| 6,305,357 | B1 | 10/2001 | Soukeras |
| 6,311,725 | B1 | 11/2001 | Hamada et al. |
| 6,314,946 | B1 | 11/2001 | Funakura et al. |
| 6,345,608 | B1 | 2/2002 | Rembold et al. |
| 6,405,711 | B1 | 6/2002 | Smith et al. |
| 6,431,838 | B2 | 8/2002 | Tanaka et al. |
| 6,484,342 | B2 | 11/2002 | Takasaki et al. |
| 6,655,360 | B1 | 12/2003 | Joos et al. |
| 6,655,366 | B2 | 12/2003 | Sakai |
| 6,679,229 | B2 | 1/2004 | Wada et al. |
| 6,718,953 | B1 | 4/2004 | Torgerud |
| 6,729,308 | B1 | 5/2004 | Kanamaru |
| 6,739,318 | B2 | 5/2004 | Nomura |
| 6,792,918 | B1 | 9/2004 | Halsall |
| 6,802,301 | B2 | 10/2004 | Fauser et al. |
| 6,866,029 | B1 | 3/2005 | Clarkson et al. |
| 6,918,380 | B2 | 7/2005 | Nomura |
| 6,925,990 | B1 | 8/2005 | Konopacki |
| 6,971,374 | B2 | 12/2005 | Saito |
| 7,114,491 | B2 | 10/2006 | Hamada et al. |
| 7,117,857 | B2 | 10/2006 | Saito et al. |
| 7,152,583 | B2 | 12/2006 | Abe et al. |
| 7,188,610 | B2 | 3/2007 | Crary et al. |
| 7,540,141 | B2 | 6/2009 | Goldberg et al. |
| 2002/0100457 | A1 | 8/2002 | Sakai |
| 2003/0221675 | A1* | 12/2003 | Washeleski ..... B60K 15/03504 123/497 |
| 2004/0003796 | A1 | 1/2004 | Nomura |
| 2006/0048757 | A1 | 3/2006 | Harvey |
| 2013/0104851 | A1* | 5/2013 | Falkowski ..... F02D 41/32 123/446 |
| 2014/0331962 | A1* | 11/2014 | Stockner ..... F02D 19/0623 123/304 |
| 2015/0035357 | A1* | 2/2015 | Greene ..... F02D 29/04 307/10.1 |

* cited by examiner

SYSTEMS FOR SUPPLYING FUEL TO FUEL-INJECTED ENGINES IN GENSETS

CROSS-REFERENCE TO RELATED APPLICATION

This application claims the benefits of U.S. Provisional Patent Application No. 62/004,415 entitled, "SYSTEMS FOR SUPPLYING FUEL TO FUEL-INJECTED ENGINES IN GENSETS," filed May 29, 2014, which is incorporated herein by reference in its entirety.

FIELD

This disclosure relates to systems and methods for supplying fuel to fuel-injected engines in generator sets ("gensets"), particularly for applications involving recreational vehicles ("RVs").

BACKGROUND

Gensets are commonly used to provide electric power to RVs. Gensets in RV applications generally lack dedicated fuel sources. Furthermore, gensets in RVs do not allow for certain arrangements which are typical of gasoline engine fuel injection systems ("EFIs"). In particular, typical gasoline EFIs incorporate either a fuel return line or provide for installation of a high pressure pump and regulator within a fuel tank to create a returnless system. However, application-specific requirements for gensets in RV do not permit the aforementioned arrangements because generally, in an RV, only one pick up port is provided at an RV fuel tank. It is generally infeasible or impractical to modify an RV fuel tank with fuel components to supply fuel to a genset.

Thus, depending on the particular RV configuration, a genset may receive fuel from propane tanks or from the fuel tank of a prime mover of an engine in the RV, for example. Furthermore, gensets for RVs require a complex set of interconnections to the RV itself. For example, such interconnections include connections at fluid, mechanical, and electrical interfaces. The complexity of interconnections makes system integration and configuration more difficult and expensive. In addition, gensets typically must start up and be responsive and fully operable despite long periods of non-use. Gensets in RVs can be prone to excessive heat generation. Producing too much heat results in difficulties in starting up and running the genset.

SUMMARY

According to various embodiments, a fuel injection system includes a fuel reservoir and a first pump fluidly coupled to the first reservoir and structured to supply fuel to the fuel reservoir. The fuel injection system is further provided with a pressure sensor and a second pump. The second pump is fluidly coupled to the pressure sensor and structured to provide pressurized fuel from the fuel reservoir to one or more fuel injectors of an associated engine. The second pump is a variable speed fuel pump.

In another set of embodiments, a fuel injection system includes a fuel reservoir and a lift pump fluidly coupled to the fuel reservoir and structured to supply fuel to the fuel reservoir. The fuel injection system further includes a fuel pump structured to provide pressurized fuel from the reservoir to a fuel injector and a regulator fluidly coupled to the fuel pump and structured to control pressure of fuel provided to the fuel injector. The regulator is provided at the fuel injector.

In yet another set of embodiments, a fuel injection system includes a fuel reservoir and a first pump fluidly coupled to the fuel reservoir and structured to supply fuel to the fuel reservoir. The fuel injections system further includes a float/fill switch configured to selectively operate the first pump in response to a level of fuel in the fuel reservoir. The fuel injection system also includes a second pump structured to provide pressurized fuel from the reservoir to at least one fuel injector and a regulator fluidly coupled to the second pump and structured to control pressure of fuel provided to the at least one fuel injector.

In a further set of embodiments, an apparatus comprises circuitry configured to receive pressure data indicative of a fuel pressure out of a variable speed fuel pump structured to provide fuel to an engine of a recreational vehicle genset, to compare the pressure data to a predetermined value, and to adjust a control signal transmitted to the variable speed fuel pump and configured to control a speed of the variable speed fuel pump responsive to the comparison.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Figure 1:
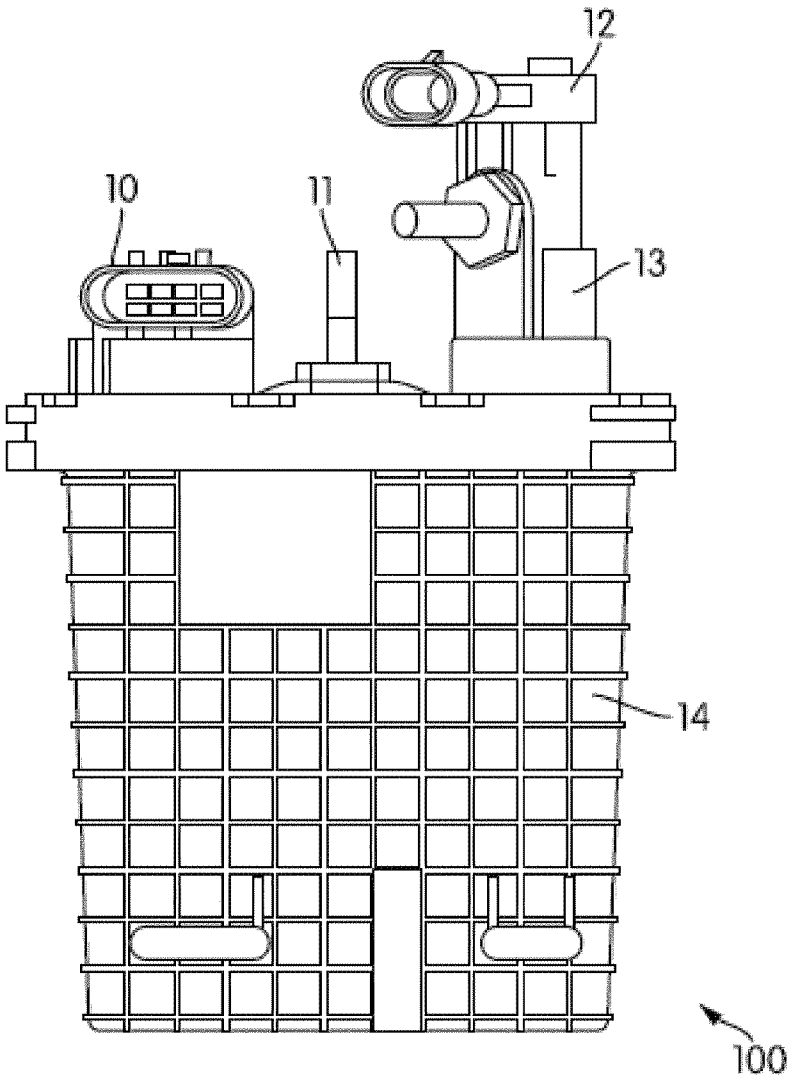
FIG. 1 is a perspective rendering of a fuel supply module.

The subject matter of the present application has been developed in response to the present state of the art, and in particular, in response to the problems and needs in the art that have not yet been fully solved for gensets in RV applications. Significant problems associated with gensets in RV applications, as noted above, are excessive heat generation and the complexity of the interfaces required to operate the genset from the RV. Accordingly, the subject matter of the present application has been developed to provide systems that supply fuel to fuel-injected engines in gensets that do not suffer from the aforementioned drawbacks.

A typical electronic fuel injection ("EFI") system, such as that found in a typical personal vehicle, generally has a fuel tank, a high pressure fuel pump, at least one fuel injector, and a pressure regulator. The high pressure fuel pump, which is usually placed within the fuel tank, provides a high pressure flow to the at least one injector via a fuel hose. The pressure regulator is usually physically placed near the at least one fuel injector and is fluidly coupled to the at least one injector. The pressure regulator regulates a near constant pressure by routing any excess flow at the at least one injector back to the fuel tank.

A returnless electronic fuel injection ("REFI") system simply moves a fuel regulator from at least one injector and instead places the fuel regulator within the fuel tank. The fuel regulator is placed downstream of the fuel pump and routes any excess flow from the pump directly back to the fuel tank to regulate the fuel pressure. The advantages of REFI include an enhanced capability for automobiles to comply with evaporative emissions regulations. In the typical, non-returnless EFI system, the excess fuel from the regulator carries back radiated heat from the engine to the fuel tank, which increases evaporative emissions. Placing the regulator within the fuel tank eliminates the recirculation of fuel and reduces fuel temperatures, while also eliminating the fuel return line. In some embodiments disclosed herein, a variable speed fuel pump is used. The speed of the fuel pump is controlled by a controller apparatus that maintains a near constant fuel outlet pressure. The use of the variable speed fuel pump allows for elimination of the regulator. Furthermore, the variable speed fuel pump is controlled so as to provide only a required flow, thus minimizing waste and heat generation from the pump. The variable speed fuel pump may be controlled by Pulse Width Modulation (PWM) voltage or by techniques other than PWM.

A system for a genset in an RV application includes a fuel injection system for the genset, which is installed in an RV. The RV may be an on-road, fifth wheel RV that includes one or more electrical appliances or other electric loads for which it would be desirable to provide power with the genset. Such a system is disclosed in U.S. Patent Application Publication Number 2013/0104851 to Falkowski, (published on May 2, 2013), the entire contents of which are incorporated herein by reference for background information and the systems, components, processes and techniques disclosed therein. Further, an RV electrical system may also accommodate shore power. The types of RV, genset, and applications can vary considerably.

FIG. 1 is a perspective rendering of a conventional fuel supply module. The fuel supply module 100 contains a pump and is defined by an inlet 12 and an outlet 13. The fuel supply module is further defined by a vent 11 and provided with a power source 10. The power source 10 can be, for example, a 12V power supply. The components of the fuel supply module 100 are integrated in a housing 14. The housing 14 can be made of any suitable material, including, for example, metallic materials. The housing 14 is configured such that a vent line extending from the vent 11 can be integrated with various components within the housing 14. For example, the vent 11 can be integrated with a regulator and reservoir within the housing 14. The housing 14 is structured to permit the vent 11 to be integrated with other components within the housing 14, such as a rollover valve and/or a float switch. A vapor separator having similar components to those described above can also be integrated with the housing 14.

Figure 2:
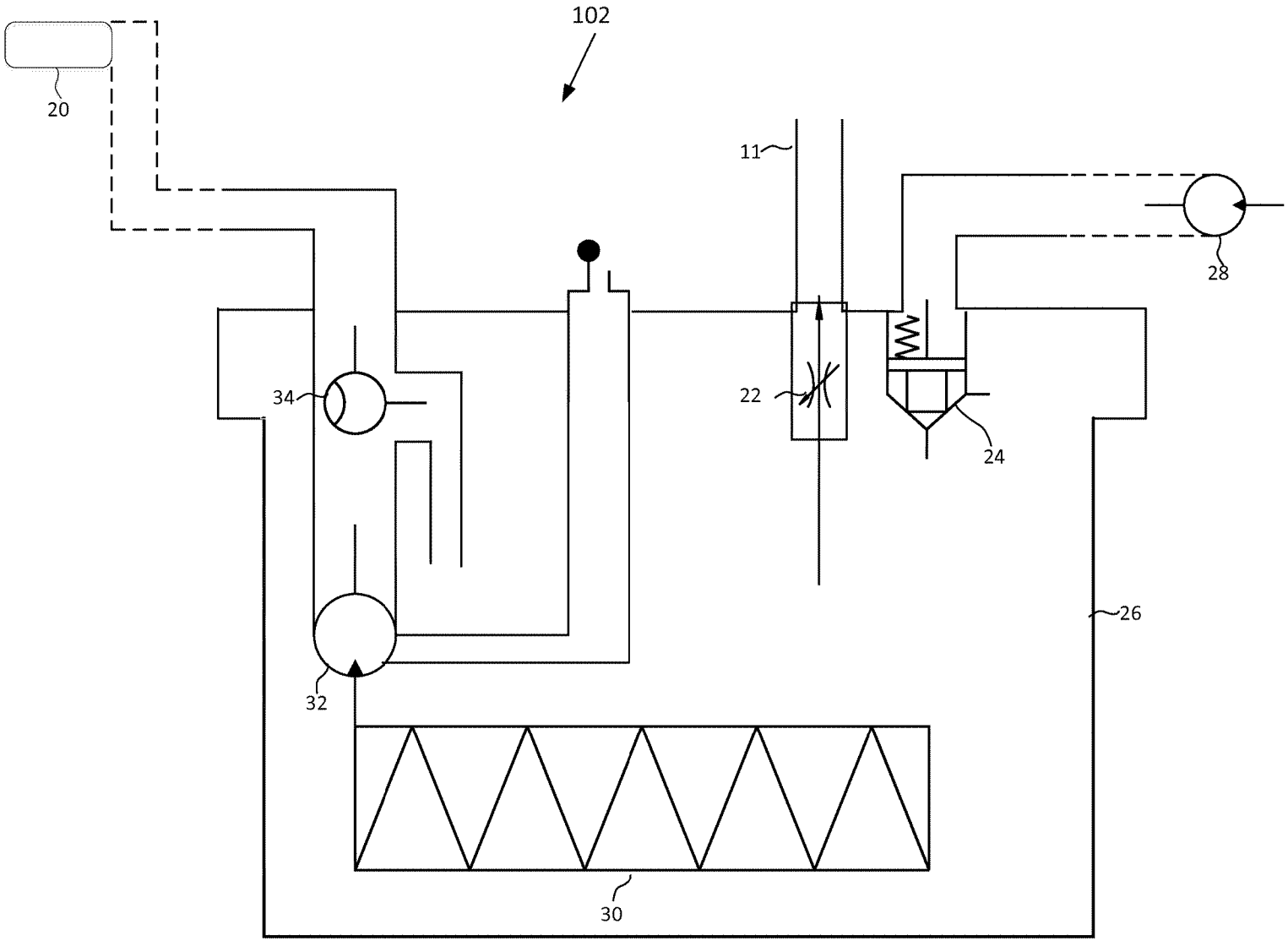
FIG. 2 is a schematic diagram of a fuel supply module.

FIG. 2 is a schematic diagram of a fuel supply module. The fuel supply module 102 includes a lift pump 28, a filter 30, a high pressure pump 32, a reservoir 26, a float/fill switch 24, a regulator 34, a rollover valve 22, and the vent 11. The fuel supply module 102 receives fuel from an RV tank via the lift pump 28 and provides pressure regulated fuel to an internal combustion engine. First, fuel from the lift pump 28 is brought to the reservoir 26 then the filter 30, where it is then filtered before being directed into the high pressure pump 32. From the high pressure pump 32, the fuel is directed to the regulator 34, from which it is either sent to reservoir 26 or to injector 20. The fuel supply module 102 is further provided with the float/fill switch 24 which switches in accordance with a level of fuel in the reservoir 26. The fuel supply module 102 is further provided with the vent 11 having a vent line including the rollover valve 22.

Fuel supply modules without a return generally suffer from poor vapor handing, particularly during hot restart operations and soaking operations. A fuel supply module such as the module 100 which is integrated in the housing 14 must employ a pressure regulator such as the regulator 34. However, the regulator 34 can be separated from the housing 14, as shown below with reference to at least some of Applicant's disclosed non-limiting embodiments. Separating the regulator 34 can allow for better access to the regulator 34. When individual components are all integrated within a housing such as the housing 34, it can be difficult to provide access to air cooling for the individual components.

Figure 3:
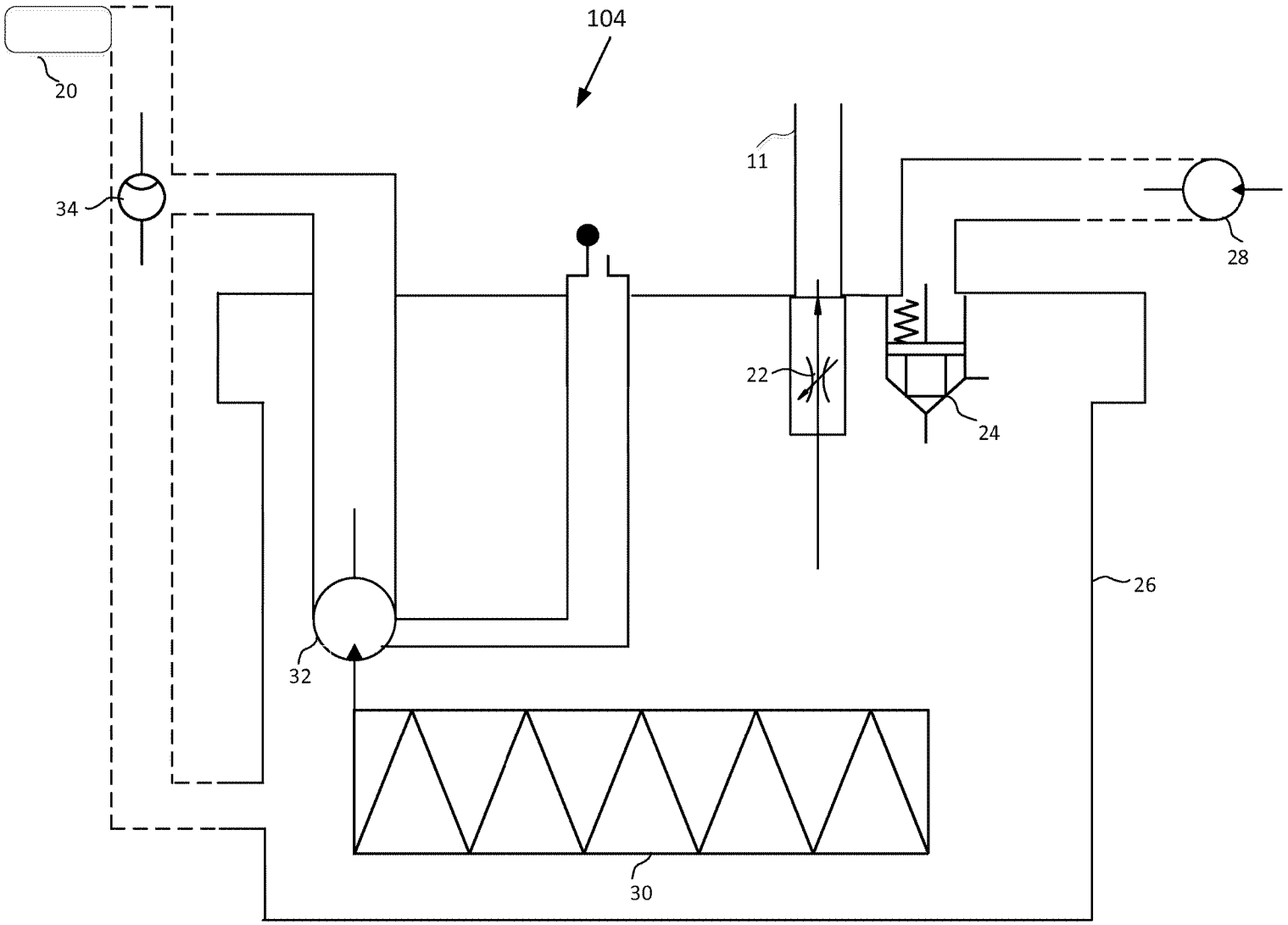
FIG. 3 is a schematic diagram of a fuel supply module according to a first embodiment.
Figure 4:
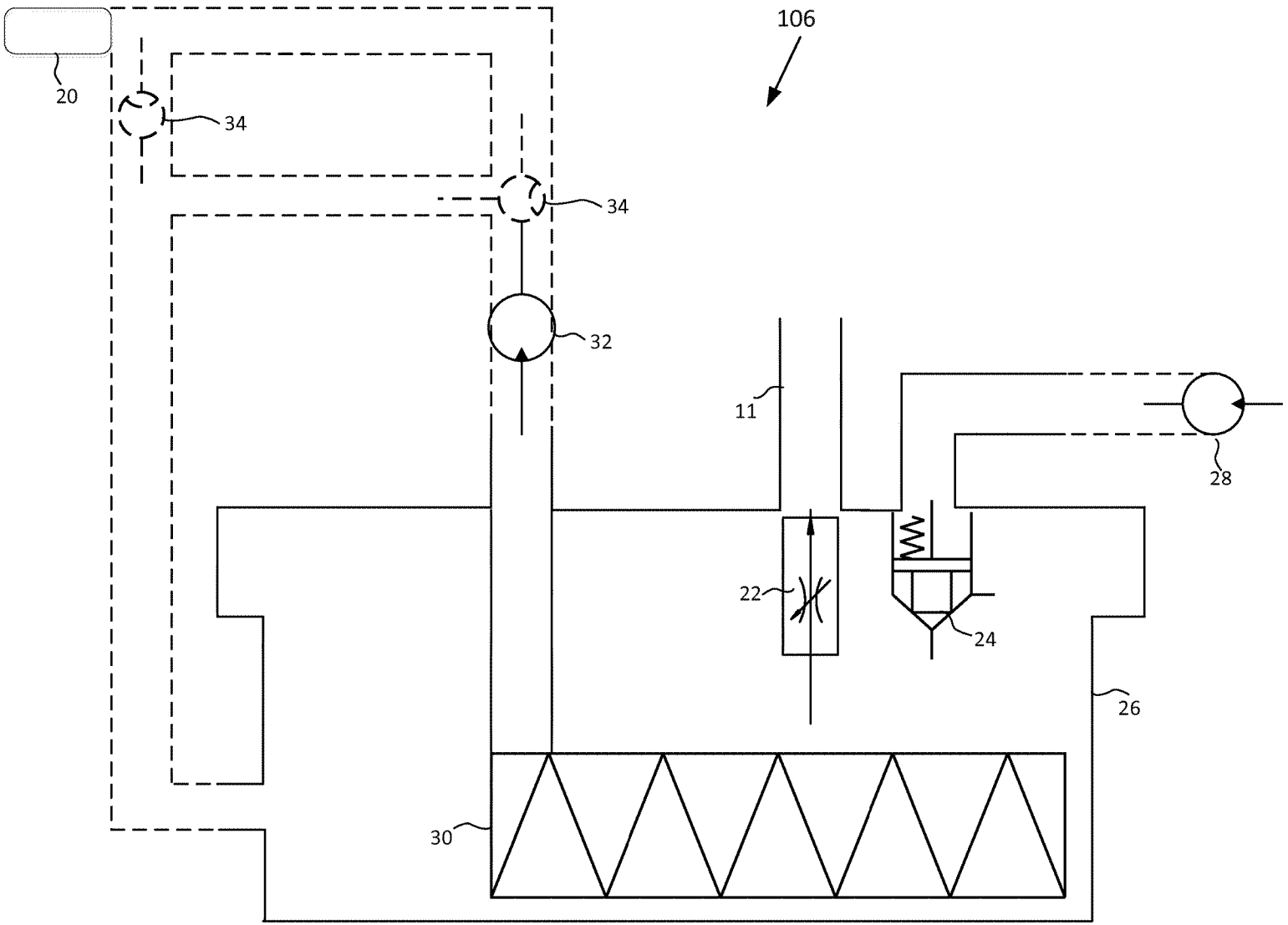
FIG. 4 is a schematic diagram of a fuel supply module according to a second embodiment.
Figure 5:
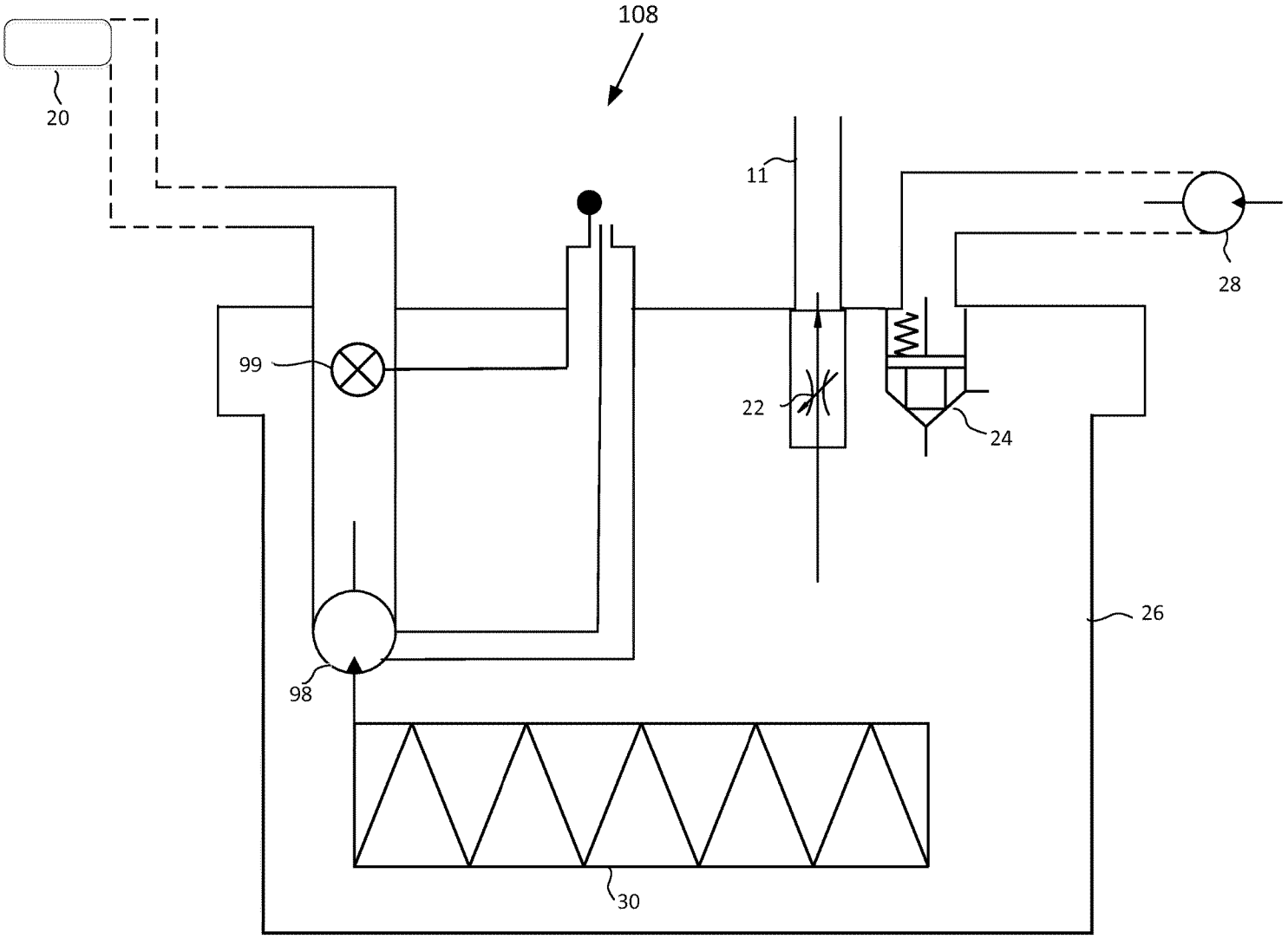
FIG. 5 is a schematic diagram of a fuel supply module according to a third embodiment.

FIGS. 3-5 depict schematic diagrams of fuel supply modules according to three embodiments. As mentioned above, typical fuel supply systems either employ a return system or have fuel supply components within the fuel tank, neither of which is desired for RV applications because only one pick up port is provided for the generator set at the RV fuel tank. Vapor separators are traditionally water cooled, while the embodiments shown in FIGS. 3-5 are not. The fuel supply modules of FIGS. 3-5 supply regulated fuel to a fuel injected generator set for RV applications. The embodiments of FIGS. 3-5 reflect varying approaches to the difficulties in RV generator set application due to only having one pickup port from an RV fuel tank. As noted above, a standard EFI system cannot be used because the RV fuel tank lacks an extra port for a fuel return line. A traditional REFI system, as discussed above, is also inapplicable because it is impractical or infeasible to place a fuel pump or a regulator within the RV fuel tank.

In systems in which the regulator 34 is separated from the housing 14, the regulator 34 can be placed at an internal combustion engine allowing for improved vapor handling. Further, at least some of Applicant's embodiments allow for the regulator 34 to be entirely eliminated, potentially reducing cost and improving serviceability. Furthermore, whereas typical fuel supply systems often include enlarged pumps in order to meet varying pressure and flow requirements, at least some of Applicant's embodiments do not require enlarged pumps. That is, typical systems have oversized pumps that are enlarged so as to meet the required fuel flow at a wide open condition or at a top engine RPM. However, when the engine is run at idle or at low engine speeds, the excess flow produced by the pump is wasted, which results in excess heat output by the pump. Instead, at least some of Applicant's embodiments use only the power and flow strength needed for a given operation, thus avoiding excess heat generation and wasted power which arise from the use of oversized pumps.

In the embodiments of FIGS. 3-5, fuel is supplied to a fuel supply module via a lift pump from a fuel tank, with the lift pump being either internal or external to a genset. In the fuel supply module shown in FIGS. 1-2 and described above, the high pressure fuel pump 32 is operated at a constant voltage, for example, 12V, and the fuel regulator 34 routes excess flow to maintain a constant set pressure.

FIG. 3 is a schematic diagram of a fuel supply module 104 according to a first embodiment. The fuel supply module 104 includes the lift pump 28, the filter 30, the high pressure pump 32, the reservoir 26, the float/fill switch 24, the regulator 34, the rollover valve 22, and the vent 11. These components are arranged similarly to those of the fuel supply module 102, except with respect to the regulator 34. In the embodiment shown in FIG. 3, the regulator 34 is provided at the injector 20 and is not disposed within a housing. By placing the regulator 34 at the injector 20, fuel vapor handling capability is increased. Nevertheless, such embodiments may be prone to increased fuel temperature due to proximity to the heat of the engine. In some embodiments, a regulator can be provided in a different location, e.g., a pump regulator provided on the pump.

In the embodiment shown in FIG. 3, the fuel supply module 104 comprises a housing containing the reservoir 26 and the pump 32, which is a continuously powered high pressure fuel pump at least partially submerged within the reservoir 26. Fuel flows through an inlet in the housing to the reservoir 26 and the pump 32. The pump provides flow to an outlet of the fuel supply module 104. The regulator 34 is external to the fuel supply module 104 or mounted on the fuel supply module 104. The regulator 34 regulates fuel pressure to the internal combustion engine and returns excess fuel to the reservoir 26. The vent 11 is included with the rollover valve 22 in the housing of the fuel supply module 104 to provide enhanced fuel vapor handling capability. Fuel volume within the housing is monitored and controlled with the float/fill switch 24. In some embodiments, the float/fill switch 24 is provided at an inlet of the fuel supply module 104 and is configured to close the inlet so as to block the supply of fuel entering the reservoir 26.

In some embodiments, the fuel supply module 104 has elements integrated in a compact housing. The reservoir 26 of the fuel supply module 104 is a small reservoir. The compact housing contains fuel, the high pressure fuel pump 32, and the regulator 34. The lift pump 28 is a low pressure lift pump that takes fuel from the RV tank and supplies fuel to an inlet to the fuel supply module 104 to fill the fuel reservoir 26. The high pressure pump 32 takes this low pressure fuel and supplies a high pressure output to the outlet of the fuel supply module 104. The fuel regulator 34 within the fuel supply module 104 is fluidly connected to the output of the high pressure pump 32 and routes any excess flow back to the fuel reservoir 26 within the fuel supply module 104 to maintain a constant output pressure. The outlet of the fuel supply module 104 is then connected to the injectors 20 via a fuel line. The fuel supply module 104 provides a constant voltage to the high pressure pump 32.

Turning to FIG. 4, a schematic diagram is shown of a fuel supply module 106, according to a second embodiment. The fuel supply module 106 has similar elements to the fuel supply module 104, but a different arrangement. The components of the fuel supply module 106 are not contained within a single housing. Instead, the components are separated and fluidly coupled either via being physically joined together to the housing or via hoses. The fuel reservoir 26 has an inlet to receive incoming fuel. The vent 11 is included with the rollover valve 22 in the reservoir 26 to provide enhanced fuel vapor handling capability. Fuel volume within the reservoir 26 is monitored and controlled with the float/fill switch 24. Fuel exits the reservoir 26 to an inlet of a high pressure pump 32. The pump 32 supplies fuel flow to an internal combustion engine. The regulator 34 on the pump 32 outlet regulates fuel pressure to the internal combustion engine and returns excess fuel to the reservoir 26.

Referring again to FIG. 4, the components of the fuel supply module 106 are separated in a manner that improves cooling and vapor handling. As indicated by the dashed lines of FIG. 4, the regulator 34 can be disposed in a plurality of positions external to the housing. Despite the separation of components, some embodiments of the fuel supply module 106 may nevertheless be susceptible to increased fuel temperatures due to proximity to the heat of the engine. Additionally, such embodiments may also require higher assembly time. The additional assembly time may arise due to the need to install a greater number of components at a genset assembly factory because these components are separated from the fuel supply module 106. Further, the fuel supply module 106, like the fuel supply module 104, provides a constant voltage to the high pressure pump 32.

Referring to FIG. 5, a schematic diagram of a fuel supply module 108 is shown, according to a third embodiment. As opposed to the pump 32 of the fuel supply modules 104 and 106, the fuel supply module 108 has a variable speed fuel pump 98. The variable speed fuel pump 98 may be, for example, a pulse width modulation ("PWM") pump that is controlled by PWM voltage. In other embodiments, however, the pump 98 is not controlled according to PWM techniques. In addition to the pump 98, the fuel supply module 108 is further provided with the fuel reservoir 26. Fuel flows through an inlet in the housing to the reservoir 26 and the pump 98, which is at least partially submerged within the reservoir 26. The pump 98 provides fuel to an internal combustion engine via an outlet in the housing of the fuel supply module 108.

Referring again to the embodiment of FIG. 5, instead of providing a constant voltage to the high pressure pump 32 (as in the fuel supply modules 104 and 106), a varying voltage to the pump 98. The varying voltage may be supplied, for example, via a PWM voltage to the pump 98. By varying the voltage, the pump 98 can maintain a constant fuel pressure without the need for the pressure regulator 34.

In some embodiments, the fuel supply module 108 is provided with a pressure sensor 99. The pressure sensor 99 is provided within the fuel line outlet. Based on input from the sensor 99, a signal to the pump 98 is varied to supply a necessary fuel flow and pressure to the engine. The vent 11 is provided with the rollover valve 22 in the housing to provide enhanced fuel vapor handling capability. Fuel volume within the housing is monitored and controlled with the float/fill switch 24. To maintain a constant fuel pressure, the fuel pressure sensor 99 is provided. In some embodiments, the fuel supply module 108 contains the fuel pressure sensor 99. In some embodiments, the fuel pressure sensor 99 is provided within the fuel supply module 108 directly downstream of the high pressure fuel pump 98.

Thus, the embodiment of FIG. 5 allows for elimination of the regulator 34. Furthermore, the fuel pump of such an embodiment is configured so as to provide only a required flow, thus minimizing waste and heat generation from the pump. The fuel supply module 108 can also reduce evaporative emissions and obviate the need for a fuel return line.

Figure 6:
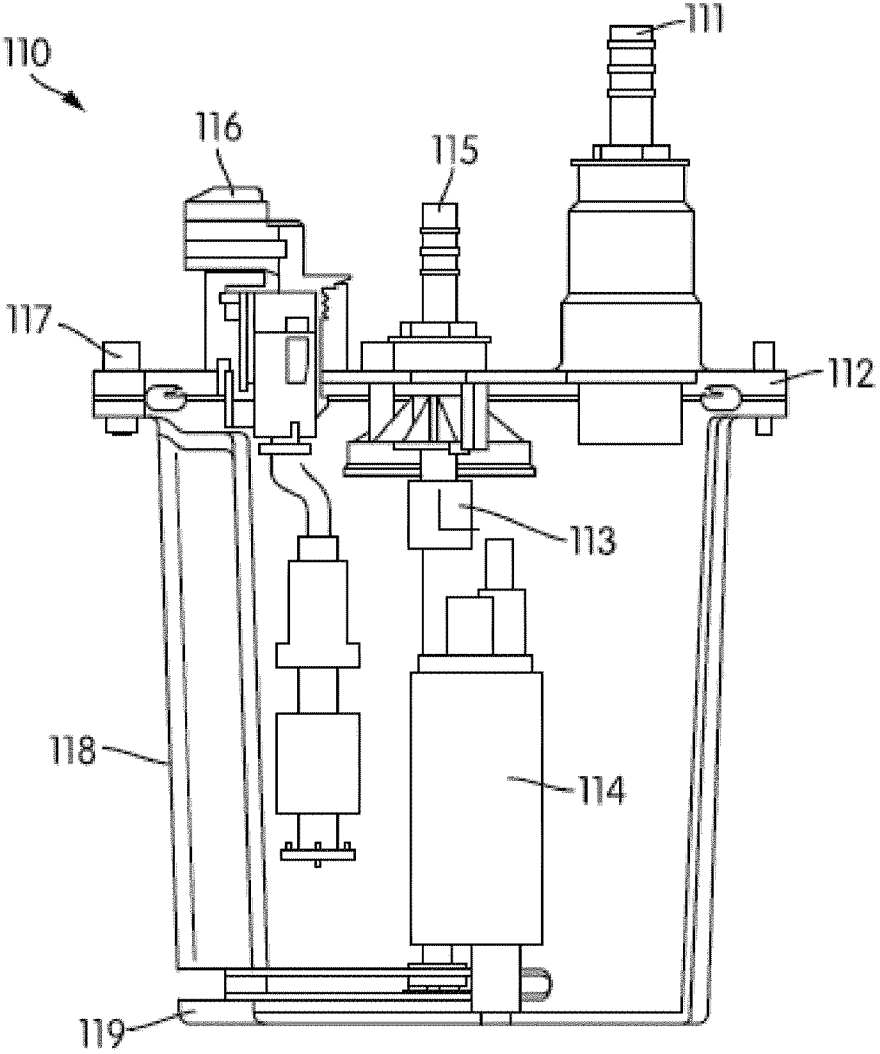
FIG. 6 is a perspective rendering of a fuel supply module according to a further embodiment.
Figure 7:
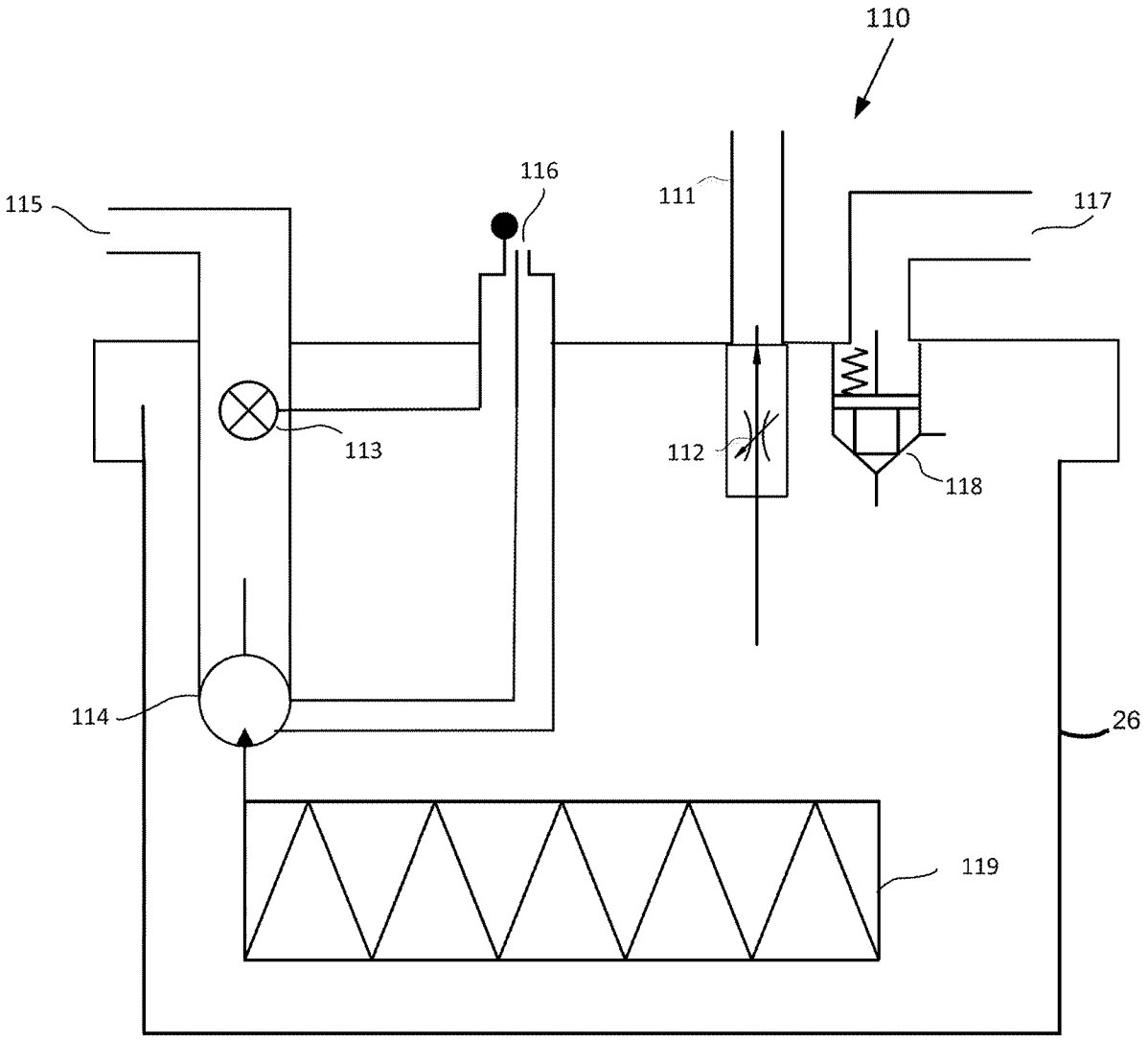
FIG. 7 is a schematic diagram of the fuel supply module of FIG. 6.

FIG. 6 is a perspective rendering of a fuel supply module 110 according to a further embodiment. The fuel supply module 110 module is similar to the fuel supply module 108 shown in FIG. 5. The fuel supply module 110 includes a vent line 111, a rollover valve 112, a pump 114, a filter 119, a fuel level switch 118, a fuel inlet 117, an electrical connector 116, and a fuel outlet 115, as well as a pressure sensor 113. The fuel pump 114 is a variable speed fuel pump. In some embodiments, the fuel pump 114 is controlled via PWM. The pressure sensor 113 is configured in the following manner. FIG. 7 is a schematic diagram of the fuel supply module 110.

In some embodiments, the fuel pressure sensor 113 reads the fuel pressure out of the fuel pump 114, which is a high pressure fuel pump, and sends this information via a linear voltage signal to a control board of a controller. The control board comprises circuitry that receives the pressure data. The control board compares the outlet pressure with a desired pressure (for example, a desired pressure between 250 kPa and 300 kPa in some embodiments). The control board then adjusts a control signal transmitted to the variable speed fuel pump 114 that controls a speed of the fuel pump 114 responsive to the comparison. For embodiments in which the fuel pump 114 is a PWM fuel pump, if the outlet pressure is low compared to the desired pressure, the control board will send a higher PWM signal to the fuel pump 114. If the outlet pressure is high compared to the desired pressure, the control board will send a lower PWM signal to the fuel pump 98. The control board is configured to run in a continuous loop to maintain a near constant fuel outlet pressure.

The magnitude of the PWM signal sent to the fuel pump 114 can be controlled by various techniques according to certain embodiments. For example, some embodiments employ a proportional-integral-derivative ("PID") control loop. The PID control loop is programmable to look at the error between the desired and the actual values. For example, if a desired value is 250 kPa, and the actual value is 260 kPa, then the error is then 10 kPa. The PID control loop is further programmable to run the error through a PID algorithm, and to output a PWM signal to the fuel pump 114 based on the output of the PID algorithm.

The controller is operable to perform one or more sequences of actions by elements of controller, which can also be a computer system or other hardware capable of executing programmed instructions, for example, a general purpose computer, special purpose computer, or other programmable data processing apparatus. In some embodiments, the controller may be in communication with a memory, which can store code related to the programmed instructions carried out by controller. The controller and memory can be in communication with an engine control module.

It will be recognized that in each of the embodiments, the various control actions could be performed by specialized circuits (e.g., discrete logic gates interconnected to perform a specialized function), by program instructions (software), such as logical blocks, program modules etc. being executed by one or more processors (e.g., one or more microprocessor, a central processing unit (CPU), and/or application specific integrated circuit), or by a combination of both. For example, embodiments of the controller can be implemented in hardware, software, firmware, middleware, microcode, or any combination thereof.

Programmed instructions can be program code or code segments that perform necessary tasks and can be stored in the memory, which is a non-transitory machine-readable medium such as a storage medium or other storage(s). A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents.

It should be noted that the orientation of the fuel supply modules are not limited to the orientations shown in the drawings, and that any suitable materials may be used for the components of the fuel supply modules.

The examples and embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. An apparatus, comprising:

circuitry configured to:

receive pressure data indicative of a fuel pressure out of a variable speed fuel pump structured to provide fuel to an engine of a recreational vehicle genset of a recreational vehicle;

compare the pressure data to a predetermined value;

adjust a control signal transmitted to the variable speed fuel pump and control a speed of the variable speed fuel pump responsive to the comparison;

adjust pressurization of fuel pumped by the variable speed fuel pump from a fuel reservoir arranged to receive fuel from a fuel tank of the recreational vehicle; and control the variable speed fuel pump to maintain a constant fuel pressure without a pressure regulator, and control a return of excess fuel from the fuel reservoir to the fuel tank of the recreational vehicle, and an electrical connector extending from a portion of the fuel reservoir and disposed so as to be contained between a fuel inlet and a fuel outlet in a lateral direction of the fuel reservoir.

2. The apparatus of claim 1, further comprising:

the fuel reservoir;

a first pump fluidly coupled to the fuel reservoir; and a float/fill switch configured to selectively operate the first pump in response to an amount of fuel in the fuel reservoir, wherein the variable speed fuel pump is structured to provide pressurized fuel from the fuel reservoir to the engine of the recreational vehicle genset in accordance with the control signal.

3. The apparatus of claim 2, further comprising a vent line having a rollover valve.

4. The apparatus of claim 1, wherein the circuitry is programmed to:

control the variable speed fuel pump to maintain the constant fuel pressure between 250 kPA-300 kPa without a return line.

5. The apparatus of claim 2, wherein:

the float/fill switch is communicated with the circuitry, and the circuitry is configured to receive a signal from the float/fill switch and selectively operate the first pump in response to the signal from the float/fill switch.

6. The apparatus of claim 3, further comprising:

a filter arranged with the fuel reservoir such that the filter is configured to receive fuel from the fuel reservoir;

wherein the vent line is coupled to the fuel reservoir.

7. The apparatus of claim 1, wherein:

the control signal is a pulse width modulation (PWM) signal;

the circuitry is configured to adjust a magnitude of the PWM signal based on a difference between a first pressure and a second pressure sensed by a pressure sensor, the pressure sensor being disposed between the variable speed fuel pump and the fuel outlet; and when the second pressure is lower than a desired pressure, the circuitry is configured to increase the control signal to the variable speed fuel pump to compensate for the difference.

8. The apparatus of claim 1, further comprising:

adjusting, by the circuitry, a magnitude of the control signal, which is a pulse width modulation signal, based on a difference between a first pressure and a second pressure, wherein the difference represents an error value.

9. The apparatus of claim 4, wherein:

the circuitry is configured to cause a varying voltage to be supplied to the variable speed fuel pump, and to control the variable speed fuel pump to output a required flow of fuel, without the pressure regulator.

10. A method, comprising:

receiving, via circuitry, pressure data indicative of a fuel pressure out of a variable speed fuel pump structured to provide fuel to an engine of a recreational vehicle genset of a recreational vehicle;

comparing the pressure data to a predetermined value;

transmitting a control signal to the variable speed fuel pump;

adjusting the control signal transmitted to the variable speed fuel pump and controlling a speed of the variable speed fuel pump responsive to the comparison;

adjusting pressurization of fuel pumped by the variable speed fuel pump from a fuel reservoir arranged to receive fuel from a fuel tank of the recreational vehicle;

controlling the variable speed fuel pump to maintain a constant fuel pressure without a pressure regulator, and controlling a return of excess fuel from the fuel reservoir to the fuel tank of the recreational vehicle, wherein an electrical connector extends from a portion of the fuel reservoir and is disposed so as to be contained between a fuel inlet and a fuel outlet in a lateral direction of the fuel reservoir.

11. The method of claim 10, further comprising:

providing the fuel reservoir to store fuel;

fluidly coupling a first pump to the fuel reservoir;

activating a float/fill switch to selectively operate the first pump in response to an amount of fuel in the fuel reservoir; and providing, by the variable speed fuel pump, pressurized fuel from the fuel reservoir to the engine of the recreational vehicle genset in accordance with the control signal.

12. The method of claim 11, further comprising:

directing fuel vapor to a vent line having a rollover valve.

13. The method of claim 10, further comprising:

controlling the variable speed fuel pump to output a required flow of fuel, without the pressure regulator.

14. The method of claim 11, further comprising:

communicating the float/fill switch with the circuitry and receiving a signal from the float/fill switch, and selectively operating the first pump in response to the signal from the float/fill switch.

15. The method of claim 12, further comprising:

disposing a filter with the fuel reservoir and receiving, by the filter, fuel from the fuel reservoir, wherein the vent line is coupled to the fuel reservoir.

16. The method of claim 10, further comprising:

sensing, by a pressure sensor, a first pressure and a second pressure, the pressure sensor being disposed between the variable speed fuel pump and the fuel outlet;

adjusting, by the circuitry, a magnitude of the control signal, which is a pulse width modulation signal, based on a difference between the first pressure and the second pressure, and when the second pressure is lower than a desired pressure, increasing the control signal to the variable speed fuel pump to compensate for the difference.

17. The method of claim 10, further comprising:

adjusting, by the circuitry, a magnitude of the control signal, which is a pulse width modulation signal, based on a difference between a first pressure and a second pressure, wherein the difference represents an error value.

18. The method of claim 10, wherein the circuitry is configured to cause a varying voltage to be supplied to the variable speed fuel pump.

19. The apparatus of claim 4, wherein:

the circuitry is programmed to maintain the constant fuel pressure of the fuel pumped by the variable speed fuel pump from the fuel reservoir, and the variable speed fuel pump is housed in the fuel reservoir.

20. The apparatus of claim 19, wherein the variable speed fuel pump is in fluid communication with a single port of the fuel tank of the recreational vehicle.

21. The method of claim 13, further comprising:

maintaining the constant fuel pressure of the fuel pumped by the variable speed fuel pump from the fuel reservoir, wherein the variable speed fuel pump is housed in the fuel reservoir.

22. The method of claim 21, wherein the variable speed fuel pump is in fluid communication with a single port of the fuel tank of the recreational vehicle.

* * * * *